US007486919B2

(12) United States Patent
Furuya

(10) Patent No.: US 7,486,919 B2
(45) Date of Patent: Feb. 3, 2009

(54) TRANSFER APPARATUS AND IMAGE FORMING APPARATUS

(75) Inventor: Satoru Furuya, Tokyo (JP)

(73) Assignee: Oki Data Corporation, Tokyo (JP)

( * ) Notice: Subject to any disclaimer, the term of this patent is extended or adjusted under 35 U.S.C. 154(b) by 351 days.

(21) Appl. No.: 11/363,929

(22) Filed: Mar. 1, 2006

(65) Prior Publication Data

US 2006/0198667 A1 Sep. 7, 2006

(30) Foreign Application Priority Data

Mar. 2, 2005 (JP) ..... 2005-057804

(51) Int. Cl.
*G03G 15/16* (2006.01)

(52) U.S. Cl. ..... 399/313

(58) Field of Classification Search ..... 399/159, 399/222, 252, 279, 299, 302, 313
See application file for complete search history.

(56) References Cited

U.S. PATENT DOCUMENTS 5,978,637 A 11/1999 Sakai et al.
6,819,899 B2 * 11/2004 Miyakawa et al. ..... 399/252
6,875,550 B2 * 4/2005 Miyakawa et al. ..... 399/252

FOREIGN PATENT DOCUMENTS

JP 10-133496 5/1998

* cited by examiner

*Primary Examiner*—William J Royer
(74) *Attorney, Agent, or Firm*—Rabin & Berdo, P.C.

(57) ABSTRACT

A transfer unit transfers an image formed on an image bearing body (a photoconductive drum or an intermediate transfer belt) onto a medium by an electrostatic force. The transfer unit includes a transfer belt and a transfer roller. The transfer roller extends parallel to the image bearing body and transfers a toner image onto a medium. The transfer roller is pressed toward the image bearing body under a pressing force in a range of 28-112 gf/cm. The transfer belt is held between the transfer roller and the image bearing body in a sandwiched relation to define a transfer point between the transfer belt and the image bearing body. The transfer belt transports the medium through the transfer point.

19 Claims, 14 Drawing Sheets

| MATERIAL | SEMICONDUCTIVE POLYAMIDE-IMIDE |
|---|---|
| THICKNESS ($\mu$m) | 100 |
| VOLUME RESISTIVITY ($\Omega \cdot$ cm) | $5\times10^{12}$ |
| SURFACE RESISTIVITY ($\Omega \cdot \square$) | $2\times10^{13}$ |
| YOUNG'S MODULOUS (Mpa) | $4.6\times10^{3}$ |

| MATERIAL | EPICHLOROHYDRINE-ETHYLENE OXIDE (ECO), ACRYLONITRILE-BUTADIENE RUBBER (NBR) |
|---|---|
| OUTER DIAMETER (mm) | 14 |
| CONDUCTIVE SHAFT (mm) | 6 |
| RESISTANCE (Ω) (1kv, 1kgf) | $3.6 \times 10^7$ |
| HIGHEST RESISTANCE/ LOWEST RESISTANCE IN CIRCUMFERENTIAL DIRECTION | 1.1 |
| HARDNESS (Askar C) FORCE EXERTED : 1kgf | 30 |
| CELL DIAMETER (μm) | 200 ~ 500 |

FIG.11

| ROLLER | RESISTANCE | PRESSING FORCE | RESISTANCE Ω | | VOLTAGE DEPENDENCY |
|---|---|---|---|---|---|
| | | gf/cm | $V_L$: 1600v | $V_{TR}$: 800v | ΔR |
| A | LOW RESISTANCE | 19 | 3.56E+07 | 3.94E+07 | 0.10 |
| B | HIGH RESISTANCE | 19 | 7.11E+07 | 8.25E+07 | 0.14 |

FIG.13

| EXAMPLE | PRESSING FORCE | VOLTAGE DEPENDENCY | | IMAGE QUALITY AFTER ENDURANCE TEST | |
|---|---|---|---|---|---|
| | | BEFORE ENDURANCE TEST | AFTER ENDURANCE TEST | HALFTONE | TEXT |
| | gf/cm | ΔR | ΔR | | |
| 1 | 112 | 0.08 | 0.29 | GOOD | GOOD |
| 2 | 93 | 0.10 | 0.30 | GOOD | GOOD |
| 3 | 65 | 0.10 | 0.32 | GOOD | GOOD |
| 4 | 37 | 0.10 | 0.34 | POOR (FAINTNESS) | GOOD |
| 5 | 28 | 0.12 | 0.36 | POOR (FAINTNESS) | POOR (FAINTNESS) |
| 6 | 19 | 0.14 | 0.49 | POOR (FAINTNESS) | POOR (FAINTNESS) |

| ROLLER | ENDURANCE TEST | PRESSING FORCE | RESISTANCE Ω | | VOLTAGE DEPENDENCY |
|---|---|---|---|---|---|
| | | gf/cm | $V_L$: 1600v | $V_{TR}$: 800v | ΔR |
| ROLLER B | BEFORE ENDURANCE TEST | 19 | 7.11E+07 | 8.25E+07 | 0.14 |
| EXAMPLE 6 | AFTER ENDURANCE TEST | 19 | 6.27E+07 | 1.23E+08 | 0.49 |

| MATERIAL | SEMICONDUCTIVE POLYVINYLIDENE DIFLUORIDE (PVDF) |
|---|---|
| THICKNESS (μm) | 100 |
| VOLUME RESISTIVITY (Ω・cm) | $6\times10^{9}$ |
| SURFACE ROUGHNESS Rz (μm) | 12 |

FIG.19

| | |
|---|---|
| TUBE | SEMICONDUCTIVE POLYVINYLIDENE DIFLUORIDE (PVDF) |
| RESILIENT FOAMED RUBBER | EPICHLOROHYDRINE-ETHYLENE OXIDE (ECO) ACRYLONITRILE-BUTADIENE RUBBER (NBR) |
| OUTER DIAMETER (mm) | 14 |
| CONDUCTIVE SHAFT (mm) | 6 |
| RESISTANCE (Ω) (1kv, 1kgf) | $5.7\times10^{7}$ |
| HIGHEST RESISTANCE/ LOWEST RESISTANCE IN CIRCUMFERENTIAL DIRECTION | 1.1 |
| HARDNESS (Askar C) EXERTED FORCE 1kgf | 55 |
| SURFACE ROUGHNESS (μm) | 12 |

FIG.20

| EXAMPLE | PRESSING FORCE | VOLTAGE DEPENDENCY | | IMAGE QUALITY AFTER ENDURANCE TEST | |
|---|---|---|---|---|---|
| | | BEFORE ENDURANCE TEST | AFTER ENDURANCE TEST | HALFTONE | TEXT |
| | gf/cm | ΔR | ΔR | | |
| 1 | 112 | 0.08 | 0.29 | GOOD | GOOD |
| 2 | 93 | 0.10 | 0.30 | GOOD | GOOD |
| 3 | 65 | 0.10 | 0.32 | GOOD | GOOD |
| 4 | 37 | 0.10 | 0.34 | POOR (FAINTNESS) | GOOD |
| 5 | 28 | 0.12 | 0.36 | POOR (FAINTNESS) | GOOD |
| 6 | 19 | 0.14 | 0.49 | POOR (FAINTNESS) | POOR (FAINTNESS) |

TRANSFER APPARATUS AND IMAGE FORMING APPARATUS

BACKGROUND OF THE INVENTION

1. Field of the Invention

The present invention relates to a transfer apparatus and an image forming apparatus.

2. Description of the Related Art

A conventional image forming apparatus incorporates a transfer roller that transfers a toner image from a photoconductive drum onto a medium such paper. If the transfer roller has a hard surface, the toner image is not transferred normally, resulting in uneven transfer of the toner image. A transfer apparatus has been proposed which uses a transfer roller having a surface formed of a foamed material. Thus, a transfer roller with less hardness can be obtained.

Foamed cells exposing on the surface as in the conventional transfer apparatus exhibit poor endurance performance. In other words, as the cumulated number of printed pages increases, the resistance of the transfer roller increases, and therefore the voltage dependency of the resistance increases. This makes it difficult to control transfer current, and causes poor image quality.

SUMMARY OF THE INVENTION

An object of the present invention is to solve the problems of the conventional transfer apparatus.

Another object of the invention is to provide a transfer apparatus in which a force for urging the transfer roller against the image bearing body is controlled within a desired range.

Another object of the invention is to provide a transfer apparatus in which high endurance performance is obtained, the voltage dependency of the resistance of the transfer roller is minimized, and a good image quality being obtained.

Yet another object of the invention is to provide an image forming apparatus incorporating the above-described transfer apparatus.

A transfer unit transfers an image formed on an image bearing body onto a medium by an electrostatic force. The transfer unit includes a transfer belt and a transfer roller. At least one transfer roller faces the image bearing body and transfers a developer image onto a medium. The transfer roller is pressed against the image bearing body under a pressing force in a range of 28-112 gf/cm.

An image forming apparatus incorporates the transfer unit.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIG. 11 illustrates the characteristics of the transfer roller before the endurance test;

FIG. 13 is a table that lists the characteristics of Examples 1-6 of the transfer roller;

FIG. 19 is a table that lists the major specifications of the secondary transfer roller with the resin tube fitted over it; and FIG. 20 is a table that lists the major characteristics of the secondary transfer roller according to the second embodiment.

DETAILED DESCRIPTION OF THE INVENTION

First Embodiment

Figure 1:
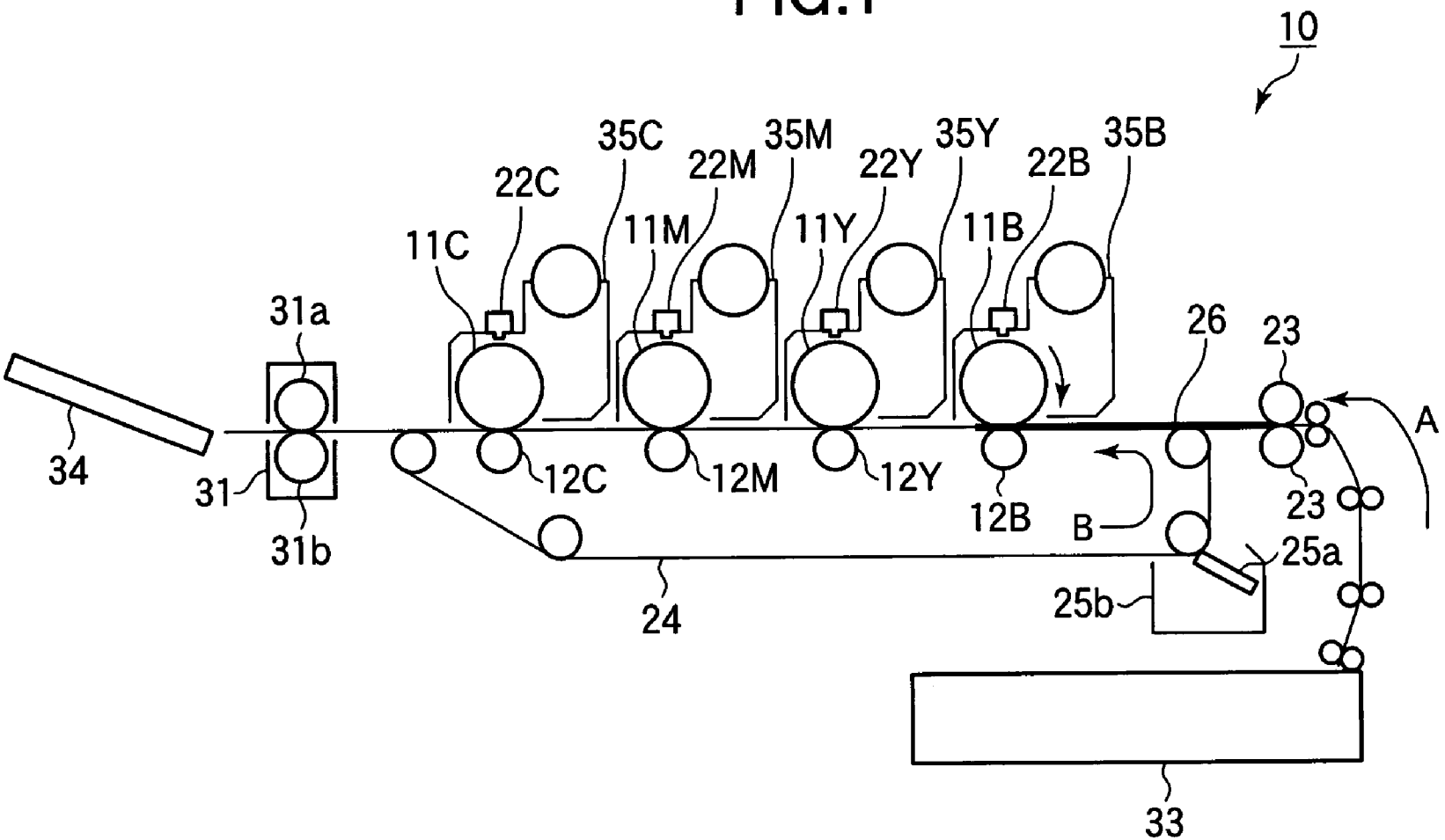
FIG. 1 illustrates a general configuration of an image forming apparatus according to a first embodiment.

FIG. 1 illustrates a general configuration of an image forming apparatus according to a first embodiment.

Referring to FIG. 1, an image forming apparatus 10 employing electrophotography includes an electrophotographic printer, a facsimile machine, a copying machine, or a multi function peripherals (MFP) that performs as a printer, facsimile machine, and a copying machine. The image forming apparatus 10 will be described in terms of a tandem type electrophotographic color printer. An endless transfer belt 24 is entrained about a plurality of rollers. A medium is fed into a transport path and in a direction shown by arrow A and is further transported through a plurality of image forming sections as the transfer belt 24 runs.

A medium 26 is, for example, print paper or a transparency (OHP). A paper cassette 33 holds a stack of medium 26. A registration roller 23 feeds the medium 26 to the first image forming section in timed relation with image formation. Image forming units 35B, 35Y, 35M, and 35C form black, yellow, magenta, and cyan toner images, respectively.

The transfer belt 24 supports the medium 26 thereon and rotates in a direction shown by arrow B to transport the medium 26 through the image forming units 35B, 35Y, 35M, and 35C. A fixing unit 31 includes a heat roller 31*a* and a pressure roller 31*b* urged against the heat roller 31*a* by an urging means, not shown. The heat roller 31*a* incorporates a heater, not shown, therein. As the medium 26 passes through a fixing point defined between the heat roller 31*a* and the pressure roller 31*b*, the toner images of the respective colors on the medium 26 are fixed into a full color permanent image under heat and pressure.

The medium 26 is then discharged onto a stacker 34. A cleaning blade 25*a* scrapes unwanted residual toner and foreign matter from the transfer belt 24. The cleaning blade 25*a* abuts the transfer belt 24 such that the transfer belt 24 is sandwiched between the cleaning blade 25*a* and a drive roller. The toner and foreign matter fall into a waste toner box 25*b* supported on a frame, not shown.

Photoconductive drums 11B, 11Y, 11M, and 11C bear black, yellow, magenta, and cyan images. Exposing units 22B, 22Y, 22M, and 22C illuminate the charged surface of the photoconductive drums 11B, 11Y, 11M, and 11C, respectively, to form electrostatic latent images of corresponding colors. Transfer rollers 12B, 12Y, 12M, and 12C are urged against the photoconductive drums 11B, 11Y, 11M, and 11C, respectively, with the transfer belt 24 sandwiched between the transfer rollers 12B, 12Y, 12M, and 12C and the photoconductive drums 11B, 11Y, 11M, and 11C.

Figure 2:
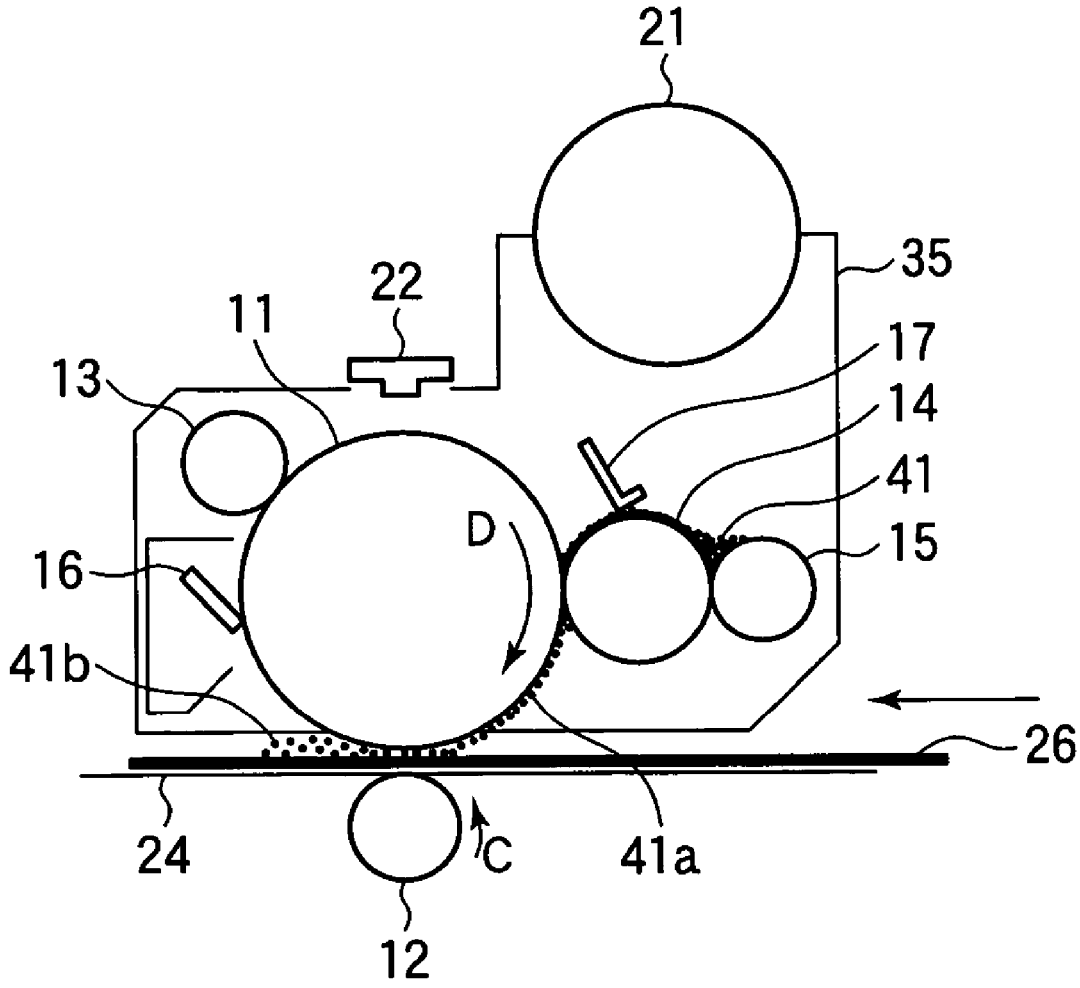
FIG. 2 illustrates an image forming unit.

FIG. 2 illustrates the image forming unit 35Y. The configuration of the image forming unit 35Y will be described. Each of the image forming units 35B, 35Y, 35M, and 35C may be substantially identical; for simplicity only the operation of the image forming unit 35Y for forming yellow images will be described, it being understood that the other image forming units may work in a similar fashion.

The photoconductive drum 11 is rotatably supported in the image forming unit 35, and is driven in rotation by a drive source, not shown. A charging roller 13, exposing unit 22, developing roller 14, transfer roller 12, and cleaning blade 16 are disposed around the photoconductive drum 11. The charging roller 13 charges the surface of the photoconductive drum 11 uniformly. The exposing unit 22 illuminates the charged surface of the photoconductive drum 11 to form an electrostatic latent image. The developing roller 14 supplies toner to the electrostatic latent image to develop the electrostatic latent image into a toner image 41*a*. The transfer roller 12 transfers the toner image 41*a* onto the medium 26. A toner image 41*b* adheres to the medium 26. The transfer roller 12 rotates in a direction shown by arrow C. The photoconductive drum 11 rotates in a direction show by arrow D. The image forming unit further includes a toner cartridge 21, a toner supplying roller 15, and a developing blade 17. The cleaning blade 16 scrapes the residual toner on the photoconductive drum 11. The toner cartridge 21 holds toner 41 therein. The toner supplying roller 15 supplies toner to the developing roller 14. The developing blade 17 controls the thickness of a thin layer of toner on the developing roller 14.

Because the image forming apparatus 10 according to the first embodiment is a tandem type color electrophotographic printer, the transfer belt 24 runs in contact with the photoconductive drum 11. The toner images on the respective photoconductive drums 11B, 11Y, 11M, and 11C are transferred directly onto the medium 26. The transfer belt 24 and transfer roller 12 form a transfer unit.

The arrangement of the photoconductive drum 11 and transfer roller 12 will be described.

Figures 3, 4:
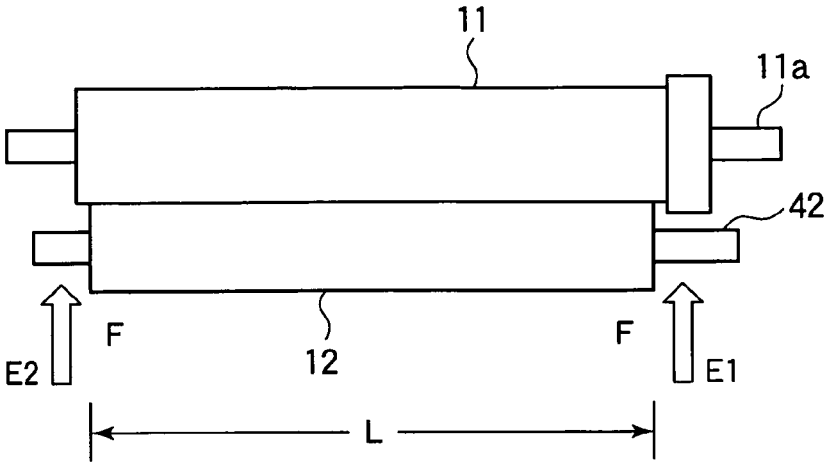
FIG. 3 illustrates the positional relation of a photoconductive drum and a transfer roller.
FIG. 4 is a table that lists the major specifications of a transfer belt.

FIG. 3 illustrates the positional relation of the photoconductive drum 11 and transfer roller 12. FIG. 4 is a table that lists specifications of the transfer belt 24.

Referring to FIG. 3, the transfer roller 12 is urged against the photoconductive drum 11 under a force F. The photoconductive drum 11 rotates about a shaft 11*a* and the transfer roller 12 rotates about a shaft 42. The force F is applied by a spring member, not shown, in directions shown by arrows E1 and E2. The pressing force $F_{TR}$ exerted by the transfer roller 12 against the photoconductive drum 11 is a value obtained by dividing 2F by L as follows:

$$F_{TR}=2F/L \qquad \text{Eq. (1)}$$

where 2F is the total force acting between the transfer roller 12 and the photoconductive drum 11 and L is the total length of the transfer roller 12 in contact with the photoconductive drum 11. The length L is equal to a length of a rubber member of the transfer roller 12, which will be described later.

The pressing force $F_{TR}$ of the transfer roller 12 may be easily adjusted by using spring members having different spring constants.

FIG. 4 lists the specifications of the transfer belt 24 integral construction with the transfer roller 12. The volume resistivity is in the range of $10^{10}$ to $10^{14}$ Ω-cm (250 V, MITSUBISHI YUKA HIGH RESTA). The surface resistivity is in the range of $10^{11}$ to $10^{16}$Ω/□ (500 V, MITSUBISHI YUKA HIGH RESTA). The value of resistivity can be adjusted by controlling the amount of conductive carbon black dispersed.

For volume resistivities smaller than $10^{10}$ Ω-cm, relatively low resistances make it easy for current to flow through the transfer belt 24, so that leakage current is apt to flow along the surface of the transfer belt 24. This causes poor transfer performance. For volume resistivities larger than $10^{14}$ Ω-cm, relatively high resistances make it difficult for current to flow, so that poor transfer performance results. For surface resistivities smaller than $10^{11}$Ω/□, relatively low resistances make it easy for current to flow inside the transfer belt 24, so that leakage current is apt to flow along the surface of the transfer belt 24. This results in poor transfer performance. For surface resistivities larger than $10^{16}$Ω/□, relatively high resistances make it difficult for current to flow, so that poor transfer performance results.

The construction of the transfer roller 12 will be described.

Figure 5:
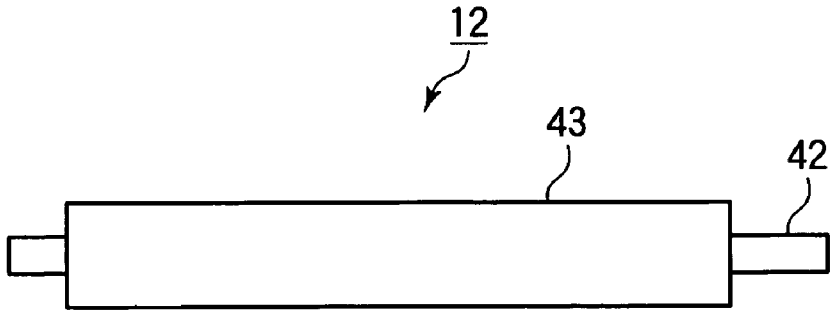
FIG. 5 is a front view of the transfer roller.
Figure 6:
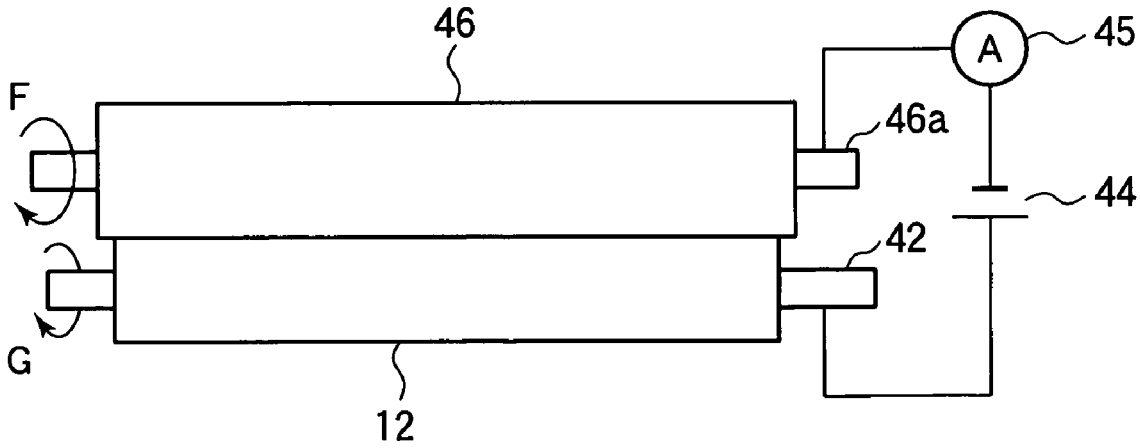
FIG. 6 illustrates the setup for measuring the resistance of the transfer roller.
Figures 7, 8:
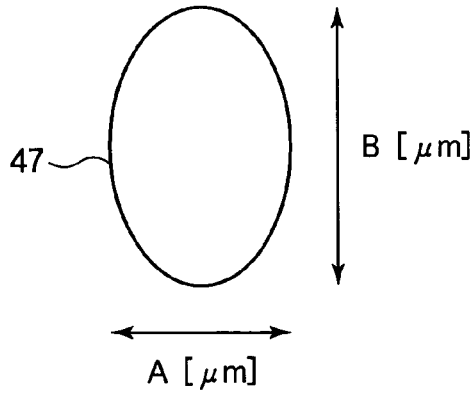
FIG. 7 is a table that lists the major specifications of the transfer roller.
FIG. 8 illustrates the definition of a cell exposed on the surface of the transfer roller.
Figure 9A:
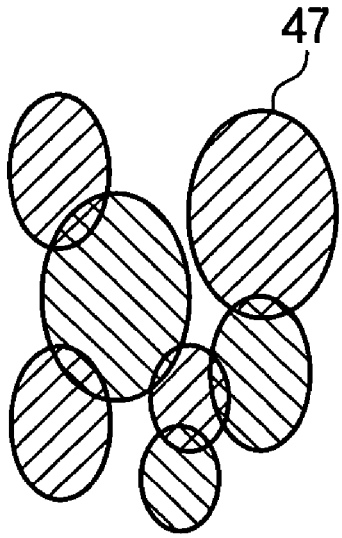
FIGS. 9A and 9B illustrate cells exposed on the surface of the transfer roller and communicating with one another.
Figure 9B:
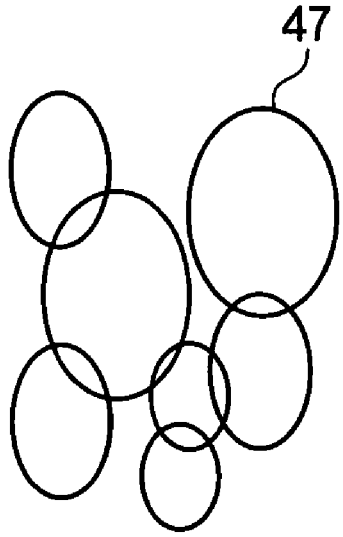

FIG. 5 is a front view illustrating the operation of the transfer roller 12. FIG. 6 illustrates the setup for measuring the resistance of the transfer roller 12. FIG. 7 is a table that lists the major specifications of the transfer roller 12. FIG. 8 illustrates the definition of the diameter of a cell 47 exposed on the surface of the transfer roller 12. FIGS. 9A and 9B illustrate cells 47 exposed on the surface of the transfer roller 12 and communicating with one another.

Referring to FIG. 5, the transfer roller 12 includes a metal shaft 42, and a rubber member 43 in the form of a resilient foamed body. The transfer roller 12 is manufactured according to the specifications in FIG. 7. The resistance of the transfer roller 12 is in the range of $10^5$-$10^{10}$Ω, and has the ratio of a highest resistance to a lowest resistance distributed in the circumferential direction is 1.5 or less.

The rubber member 43 has preferably hardness in the range of 25-45 degrees (Askar C). For materials having hardness lower than 25 degrees (Askar C), the transfer roller 12 does not contact the photoconductive drum 11 with a required pressure, so that the ability of the transfer roller 12 to transfer the toner image 41*a* onto the medium 26 becomes poor. This causes poor transfer results. For materials having hardness higher than 45 degrees (Askar C), the transfer roller 12 loses its resiliency and therefore a sufficient amount of nip is not created at a transfer point. Thus, some portions of toner image 41*a* fail to be transferred.

For the resistances of the transfer roller 12 lower than $10^5$Ω, relatively low resistances make it easy for the transfer current to flow, causing some "deformation of image" in images. For the resistances of the transfer roller 12 higher than $10^{10}\Omega$, relatively high resistances require a high transfer voltage so that a required amount of current flows between the transfer roller 12 and the photoconductive drum 11. This increases a load on the power supply. The resistance of the transfer roller 12 is such that the ratio of a highest resistance to a lowest resistance over the entire circumferential surface is 1.5 or less. A ratio greater than 1.5 causes non-uniform transfer results leading to poor image quality.

The resistance of the transfer roller 12 is measured by using the setup in FIG. 6. Referring to FIG. 6, a drum metal body 46 is supported on a shaft 46*a* and is rotated in a direction shown by arrow Fby a drive source, not shown. The transfer roller 12 rotates in a direction shown by arrow G. A constant voltage power supply 44 is connected across the metal shaft 42 of the transfer roller 12 and the shaft 46*a* of the drum metal body 46. A current meter 45 measures the current flowing out from the constant voltage power supply 44.

The resistance of the transfer roller 12 is determined based on an average value of the current that flows through the transfer roller 12 when the transfer roller 12 rotates in contact with the drum metal body 46. The drum metal body 46 has a negligibly small resistance compared with the transfer roller 12. The resistance variation in a circumferential direction is the ratio of a largest resistance Lr to a smallest resistance Sr(Lr/Sr) over the entire circumferential surface.

Referring to FIG. 7, the shaft 42 has a diameter of 6 mm and the transfer roller 12 has a diameter of 14 mm. Ideally, the shaft 42 is 6 mm or over. This is because the larger the diameter of the shaft 42, the higher the rigidity of the shaft 42. The high rigidity prevents the transfer roller 12 from flexing, and ensures that the transfer roller 12 contacts the photoconductive drum 11 uniformly in a longitudinal direction of the transfer roller 12. It is to be noted that the rigidity of the shaft 42 is proportional to the fourth power of the shaft diameter.

The diameter of the shaft 42 is preferably such that the difference between the diameter of the transfer roller 12 and the diameter is more than 2 mm. The diameter of the shaft 42 larger than the diameter of the transfer roller 12 makes the thickness of the rubber member 43 less than 2 mm, causing deterioration of the rubber member 43 due to dielectric breakdown.

The rubber member 43 is formed as follows: acrylonitrile-butadiene rubber (NBR) and Epichlorohydrin-ethylene oxide (ECO), which are base materials for the rubber member 43, are mixed, vulcanized, foamed, and shaped into a roller. The ECO rubber and NBR rubber are both polar rubbers. Especially, the ECO rubber exhibits high ionic conduction because of its ethylene oxide group.

The diameter of cells in the rubber member 43 is distributed in the range of 200-500 μm. FIG. 8 illustrates the diameter of foamed cells 47 that are exposed on the surface of the transfer roller 12. The diameter of the foamed cells is given by the following relation.

$$\text{Diameter of foamed cell}=\{\sqrt{(A\times B)}\}/2 \qquad \text{Eq. (2)}$$

where A is a minor axis in microns and B is a major axis in microns.

The diameter of foamed cell larger than 500 μm causes non-uniform discharge between the surface of the transfer roller 12 and the member that is in contact with the transfer roller 12. The diameter of foamed cell smaller than 200 μm makes the rubber material hard, failing to create a sufficient contact area between the transfer roller 12 and the member with which the transfer roller 12 is in contact. This causes unstable transfer performance.

If the foam cells 47 communicate with one another as shown in FIG. 9A, the foam cells 47 are assumed to be independent cells such that each cell has a contour as shown in FIG. 9B.

The transfer current supplied to the medium 26 will be described.

Figure 10:
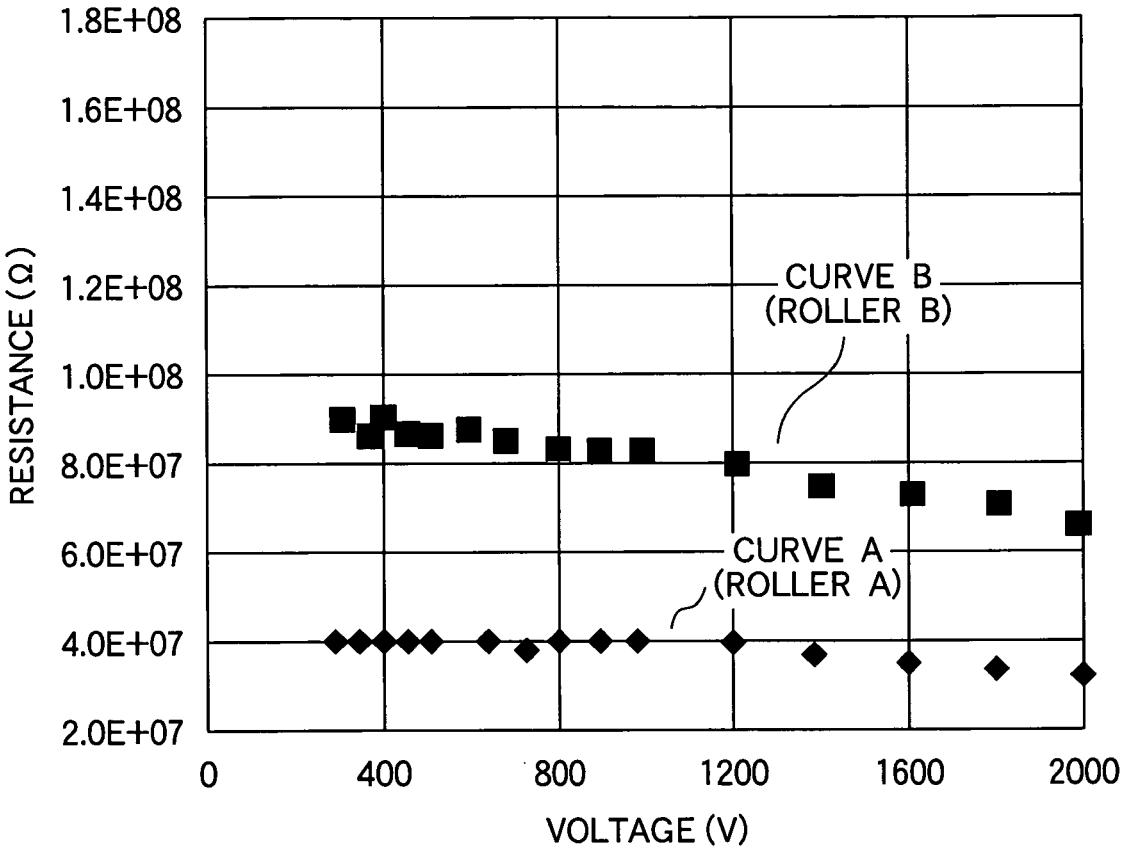
FIG. 10 is a table that lists data showing the voltage dependency of the transfer roller before an endurance test.

FIG. 10 is a table that lists data showing the voltage dependency of the transfer roller 12 before the endurance test.

FIG. 11 illustrates the characteristics of the transfer roller 12 before an endurance test.

During transfer of a toner image 41*a* onto the medium 26, the transfer current flows through the transfer belt 24, transfer roller 12, and medium 26. The transfer current should be maintained at a specific value depending on the type of the medium 26. However, the transfer belt 24 and transfer roller 12 have resistances that vary in accordance with the change in environmental conditions and the change in the number of printed pages. Thus, the following control of the transfer current is performed in order to supply the constant transfer current to the medium 26 irrespective of the change in the resistance of the transfer belt 24 and transfer roller 12.

Prior to the initiation of the image formation, transfer current is controlled by adjusting the voltage applied to the transfer roller 12. A test voltage $V_T$ of 1600 V is applied across the shaft 42 of the transfer roller 12 and the photoconductive drum 11, and then the current flowing through the transfer roller 12 is measured. A total test resistance $R_T$ of the transfer belt 24 plus the transfer roller 12 is calculated based on this current. Then, based on the test resistance $R_T$ and the resistance of a previously determined resistance of a medium, a transfer voltage $V_{TR}$ that is high enough to supply a sufficient current through the transfer roller 12 is determined. When the image formation is performed, the thus obtained transfer voltage $V_{TR}$ is applied across the shaft 42 and the photoconductive drum 11.

As described above, the transfer current is controlled by controlling the voltage applied, so that the transfer current supplied to the medium 26 can be maintained at a constant value irrespective of the change in the resistance of the transfer belt 24 and the transfer roller 12. In this manner, an optimum transfer current can be supplied to ensure reliable transfer of toner images onto the medium 26.

FIG. 10 illustrates two voltage dependencies of the resistance of the transfer roller 12. Curve A is for roller A having the lowest tolerable resistance. Curve B is for roller B having the highest tolerable resistance. FIG. 11 is a table that lists characteristics of roller A and roller B. FIGS. 10 and 11 show values before the rollers, A and B are subjected to the endurance test. The transfer voltage $V_{TR}$ is selected based on the voltage dependency of roller A and roller B. The test voltage $V_T$ is fixed to 1600 V.

Examples of the invention will be described.

Figure 12:
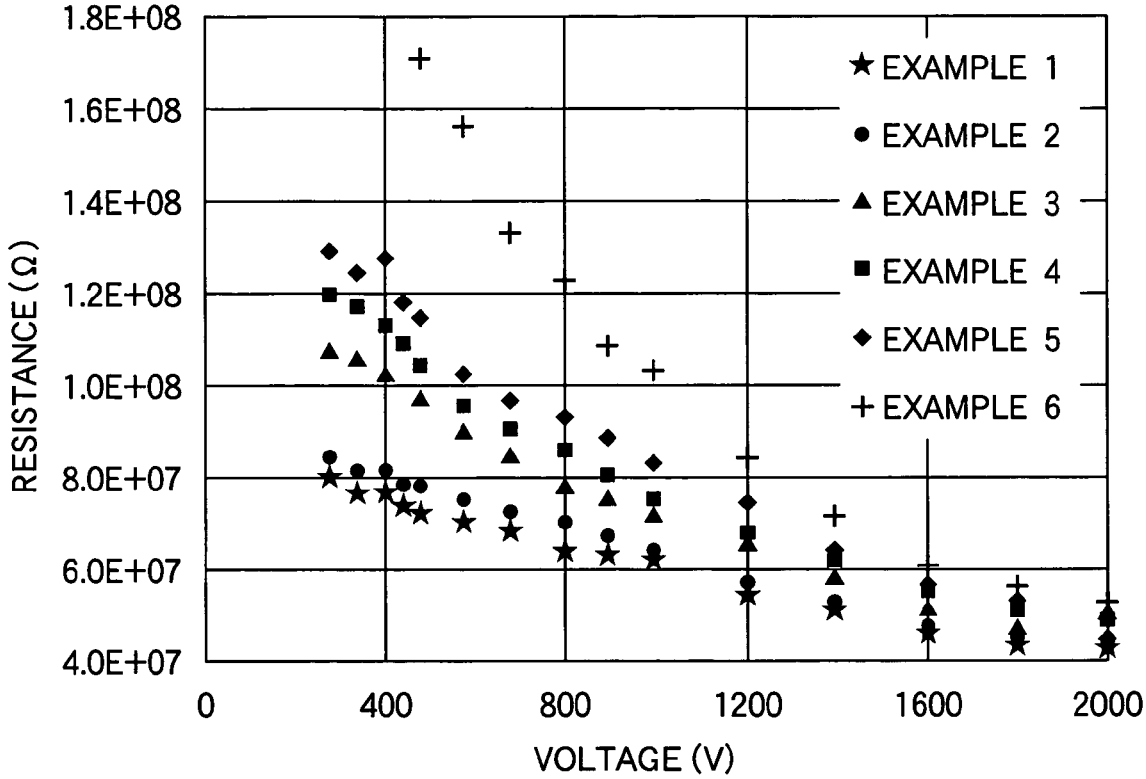
FIG. 12 illustrates the voltage dependency of the resistance of Examples 1-6 of the transfer roller according to the first embodiment.
Figure 14:
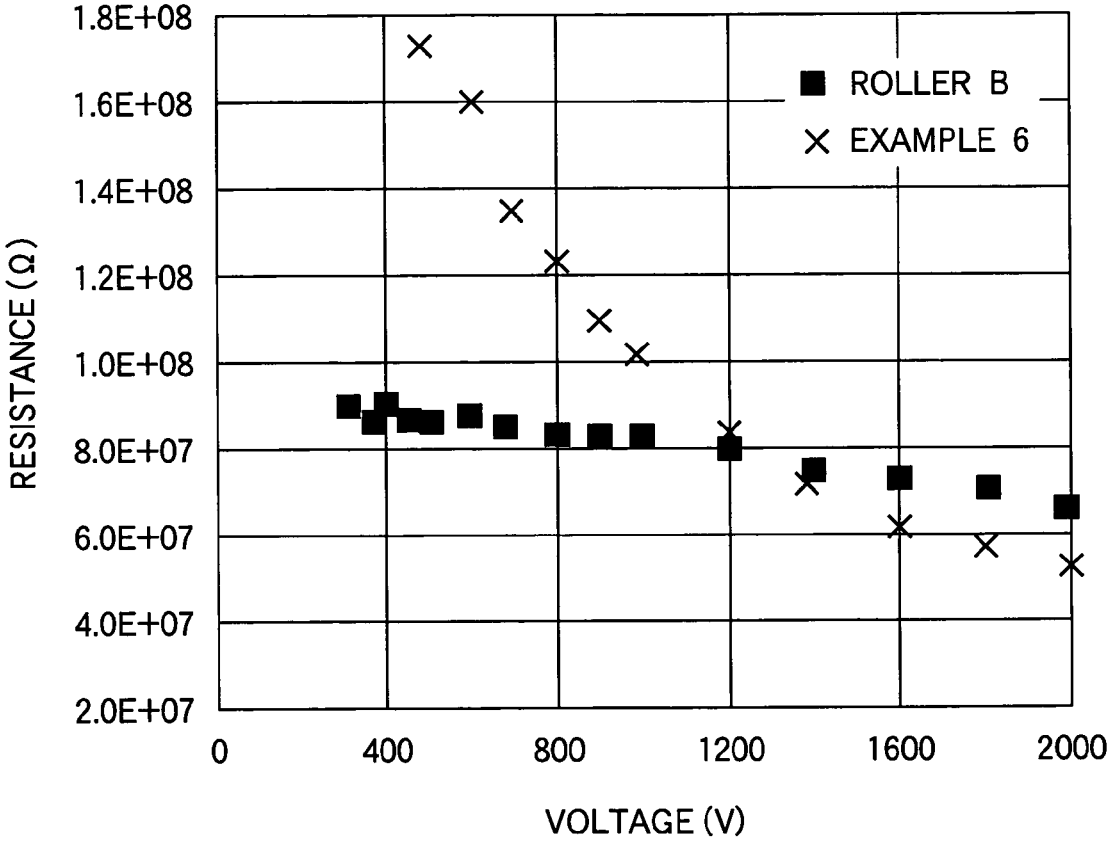
FIG. 14 illustrates a case in which transfer current cannot be controlled properly by the voltage applied to the transfer roller.
Figures 15, 16:
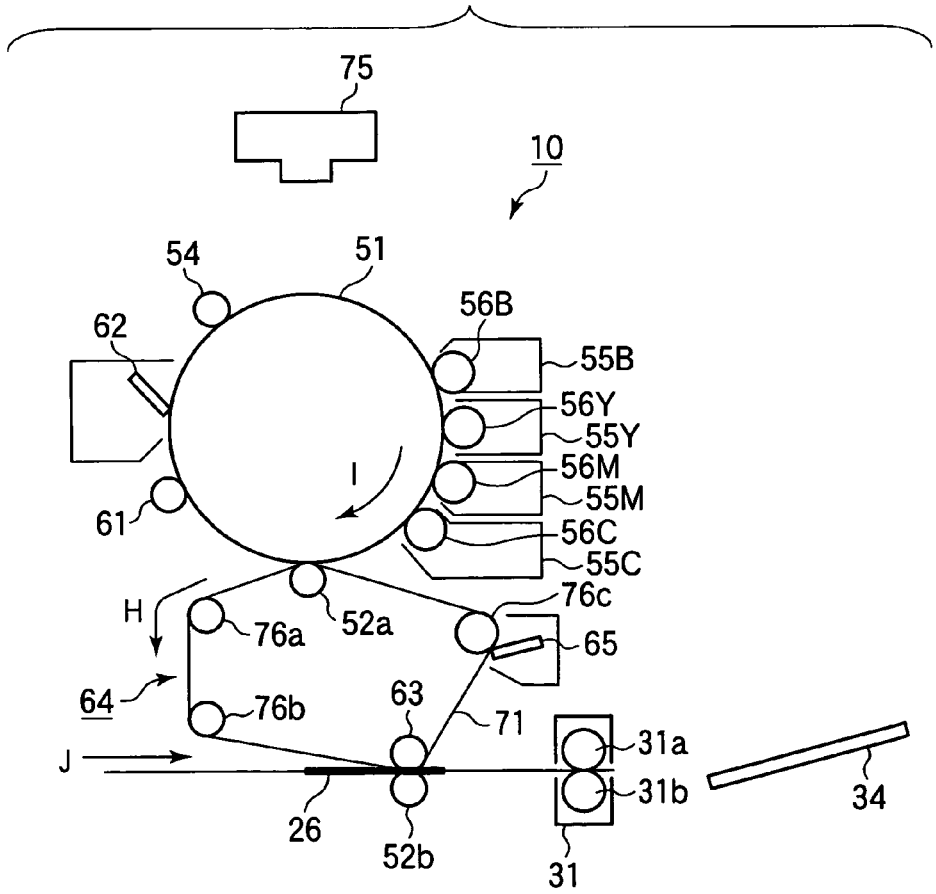
FIG. 15 illustrates the characteristics of the transfer roller for the case in FIG. 14.
FIG. 16 illustrates the configuration of an image forming apparatus according to a second embodiment.

FIG. 12 illustrates the voltage dependency of the resistance of Examples 1-6 of the transfer roller 12 according to the first embodiment. FIG. 13 is a table that lists the characteristics of Examples 1-6 of the transfer roller 12. FIG. 14 illustrates a case in which the transfer current cannot be controlled properly by the voltage applied to the transfer roller 12. FIG. 15 illustrates the characteristics of the transfer roller 12 for the case in FIG. 14.

The inventor carried out an endurance test in which printing was performed on 50,000 pages of the medium 26, and compared the voltage dependency of the resistance of the transfer roller 12. A tandem type color electrophotographic printer 10 was used which employs an LED type exposing unit and a direct transfer technique. The medium 26 is a letter-size medium. The print speed was 94 mm/sec, which is the circumferential speed of the photoconductive drum 11. The circumferential speed of the transfer roller 12 was also 94 mm/sec. The specifications of the transfer belt 24 are the same as those listed in FIG. 4. The specifications of the transfer roller 12 are the same as those listed in FIG. 7

The voltage dependency AR of the transfer roller 12 at a voltage of 1600 V, and $R_{800V}$ is the resistance of the transfer roller 12 which is close to the resistance of the resistance of the transfer roller 12 is given by the following equation.

$$\Delta R = 1 - (R_{1600V}/R_{800V}) \quad \text{Eq. 3}$$

where $R_{1600V}$ is a test resistance value when the transfer roller 12 operates during image formation.

ΔR has a value such that $0 \leqq \Delta R \leqq 1$. AR is equal to 0, if the transfer roller 12 has no voltage dependency. The larger the ΔR, the larger the voltage dependency. In other words, ΔR is a measure of the test resistance of the transfer roller 12 and the resistance of the resistance during transferring. Before the endurance test, the ΔR was nearly 0.

FIG. 12 illustrates the voltage dependency of the resistance of the transfer roller 12 for six examples after the endurance test. FIG. 13 illustrates the pressing force $F_{TR}$, the voltage dependency, and image quality after the endurance test.

Experiment were conducted with the following six examples of the roller A.

Example 1

The endurance test was performed with the pressing force $F_{TR}$ set to 112 gf/cm. ΔR was 0.08 before the endurance test, and 0.29 after the endurance test. Image quality was consistently good enough.

Example 2

The endurance test was performed with the pressing force $F^{TR}$ set to 93 gf/cm. ΔR was 0.10 before the endurance test, and 0.30 after the endurance test. Image quality was consistently good enough.

Example 3

The endurance test was performed with the pressing force $F_{TR}$ set to 65 gf/cm. ΔR was 0.10 before the endurance test, and 0.32 after the endurance test. Image quality was consistently good enough.

Example 4

The endurance test was performed with the pressing force $F^{TR}$ set to 37 gf/cm. ΔR was 0.10 before the endurance test and 0.34 after the endurance test. Image quality was good enough. The image quality before the endurance test was good enough. Poor image was observed in halftone printing after the endurance test, but image quality was good enough for text printing.

Example 5

The endurance test was performed with the pressing force $F_{TR}$ set to 28 gf/cm. ΔR was 0.12 before the endurance test and 0.36 after the endurance test. The image quality before the endurance test was good enough. Poor image was observed in halftone printing after the endurance test, but image quality was good enough for text printing.

Example 6

The endurance test was performed with the pressing force $F_{TR}$ of the transfer roller 12 into the photoconductive drum 11 set to 19 gf/cm. ΔR was 0.14 before the endurance test and 0.49 after the endurance test. The image quality before the endurance test was good enough. Faintness was observed in halftone printing and text printing after the endurance test. Example 6 is the roller A.

When the pressing force $F_{TR}$ of the transfer roller 12 was set to a larger value than 112 gf/cm, the toner particles adhere to the medium 26 at locations somewhat away from where they are intended to adhere. This reveals that a value of pressing force greater than an optimum value is detrimental.

Causes of increased voltage dependency of the resistance of the transfer roller 12 will now be considered.

When the cells in the transfer roller 12 are in the range of 200-500 μm and the pressing force $F_{TR}$ is relatively small, the surface area of the transfer roller 12 in contact with the transfer belt 24 is small. This makes the electrical conductive path to narrow, causing an electric field to concentrate. This causes discharge which in turn causes the electrical characteristics of the transfer roller 12 to deteriorate (i.e., the voltage dependency of the transfer roller 12 occurs)

Causes of occurrence of faintness of images will be considered.

FIG. 14 and FIG. 15 compare Example 6 after the endurance test with the roller B before the endurance test. FIG. 14 plots the voltage as the abscissa and the resistance as the ordinate. FIG. 15 lists the pressing force, resistance, and voltage dependency.

Referring to FIG. 15, when the transfer voltage is near 1600 V, Example 6 and roller B have substantially the same resistance before and after the endurance test. In other words, Example 6 and roller B have substantially the same test resistance $R_T$. Referring to FIG. 14, the resistance of Example 6 after the endurance test at voltages lower than 1600 V is higher than roller B. This implies that the voltage dependency of Example 6 after the endurance test is worse than roller B that is at a higher end of tolerable resistance. Such a large voltage dependency of Example 6 makes it difficult to control the transfer current. As a result, an insufficient amount of transfer current flows through Example 6, and therefore the toner image 41*a* on the photoconductive drum 11 cannot be transferred properly onto the medium 26, causing faintness.

As described above, the voltage dependency ΔR of the resistance of the transfer roller 12 after the endurance test was not larger than 0.32 when the endurance test was performed for pressing forces $F_{TR}$ not smaller than 65 gf/cm and not larger than 112 gf/cm. The results of halftone printing and text printing were good enough after the endurance test. The text printing was performed with a print duty of 5%, and the halftone printing was performed with a 2×2 pattern of 600 dpi (i.e., 2×2=4 dots were printed in 4×4=16.

When the endurance test was performed for pressing forces $F_{TR}$ not smaller than 28 gf/cm and not more than 65 gf/cm, the voltage dependency ΔR of the resistance of the transfer roller 12 after the endurance test was not less than 0.32 and not larger than 0.36. The results of halftone printing and text printing were good enough after the endurance test. The halftone printing exhibited faintness but text printing exhibited practically no problem. This is because faintness in halftone printing presents a problem only in graphics printing.

The voltage dependency ΔR of the resistance of the transfer roller 12 after the endurance test was larger than 0.36 (FIG. 13) when the endurance test was performed for pressing forces $F_{TR}$ smaller than 28 gf/cm. The image quality deteriorated prominently.

Thus, the transfer roller 12 presses the transfer belt 24 against the photoconductive drum 11 under a pressing force in the range of 28-112 gf/cm, and more preferably in the range of 65-112 gf/cm.

Second Embodiment

Elements similar to those in the first embodiment have been given the same reference numerals and their description is omitted. The description of the same operation and advantages as the first embodiment is omitted.

FIG. 16 illustrates the configuration of an image forming apparatus 10 according to a second embodiment.

The second embodiment will be described in terms of a four-cycle engine type electrophotographic color printer that employs an intermediate transfer technique. A photoconductive drum 51 (first image bearing body) bears toner images of black, yellow, magenta, and cyan. The photoconductive drum 51 is rotatably supported, and is driven in rotation in a direction shown by arrow I by a drive means, not shown. Disposed around the photoconductive drum 51 are a charging roller 54, an LED exposing unit 75, developing cartridges 55B, 55Y, 55M, and 55C, an intermediate transfer unit 64, neutralizing roller 61, and cleaning blade 62. The charging roller 54 charges the surface of the photoconductive drum 51. The LED exposing unit 75 illuminates the charged surface of the photoconductive drum 51 to form an electrostatic latent image. The developing cartridges 55B, 55Y, 55M, and 55C supplies black, yellow, magenta, and cyan toners to the electrostatic latent images, respectively, to form toner images of the respective colors. Toner images of the respective colors are then transferred onto an intermediate transfer belt 71 of the intermediate transfer unit 64 one over the other in registration. The neutralizing roller 61 neutralizes the surface of the photoconductive drum 51 after transfer of the toner image. The cleaning blade 62 removes residual toner on the photoconductive drum 51.

The developing cartridges 55B, 55Y, 55M, and 55C include developing rollers 56B, 56Y, 56M, and 56C, respectively. The developing rollers 56B, 56Y, 56M, and 56C are movable either to a developing position where the developing roller is in contact with the photoconductive drum 51 or to non-developing position where the developing roller is not in contact with the photoconductive drum 51.

The intermediate transfer unit 64 includes the intermediate transfer belt 71 (second image bearing body), a primary transfer roller 52*a*, tension rollers 76*a*, 76*b*, and 76*c*, a driven roller 63, and a cleaning blade 65. The intermediate transfer belt 71 is an endless belt that runs in a direction shown by arrow H. The primary transfer roller 52*a* presses the intermediate transfer belt 71 against the photoconductive drum 51 such that the outer surface of the intermediate transfer belt 71 is in intimate contact with the circumferential surface of the photoconductive drum 51. The intermediate transfer belt 71 in contact with the surface of the photoconductive drum 51 defines a primary transfer point. The primary transfer roller 52*a* transfers the toner image from the photoconductive drum 51 onto the intermediate transfer belt 71. The tension rollers 76*a*, 76*b*, and 76*c* maintain tension in the intermediate transfer belt 71. The driven roller 63 is in contact with the inner surface of the intermediate transfer belt 71 such that the intermediate transfer belt 71 is sandwiched between the driven roller 63 and a secondary transfer roller 52*b*. The cleaning blade 65 removes residual toner from the outer surface of the intermediate transfer belt 71. The secondary transfer roller 52*b* is urged by an urging means, not shown, against the outer surface of the intermediate transfer belt 71, and operates to transfer the toner image from the intermediate transfer belt 71 onto a medium 26. The rest of the image forming apparatus including a fixing unit 31 is the same as that of the first embodiment and the description is omitted.

The configuration of the secondary transfer roller 52*b* will be described.

Figures 17, 18:
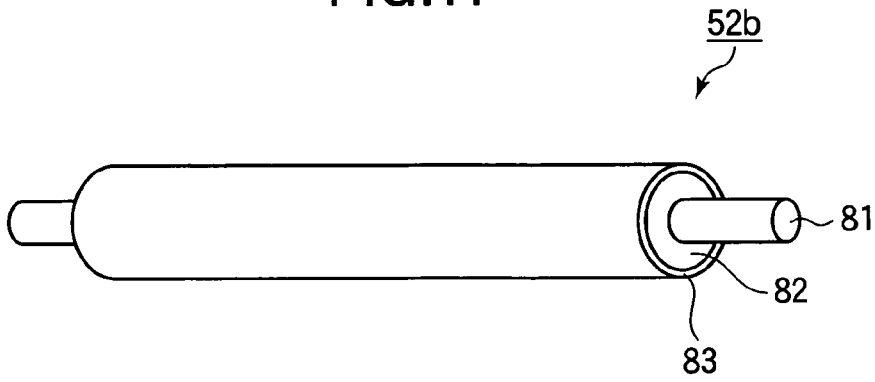
FIG. 17 is a perspective view of the secondary transfer roller.
FIG. 18 is a table that lists the major specifications of a resin tube according to the second embodiment.

FIG. 17 is a perspective view of the secondary transfer roller 52*b*. FIG. 18 is a table that lists the specification of a resin tube according to the second embodiment.

The secondary transfer roller 52*b* includes a metal shaft 81, a rubber member 82 formed on the shaft 81, and a resin tube 83 fitted over the rubber member 82. The rubber member 82 is formed of a resilient foamed rubber. The specifications of the shaft 81 and the rubber member 82 are the same as those in FIG. 7. The rubber member 82 has cells having a diameter in the range of 200-500 μm.

The resin tube 83 is made of polyvinylidene fluoride (PVdF) and has a volume resistivity preferably in the range of $10^7$-$10^{11}$ Ω-cm (250 V, MITSUBISHI YUKA HIGH RESTA). The specifications of the resin tube 83 are shown in FIG. 18. A belt having volume resistivity of $10^7$ Ω-cm has a low resistance, so that leakage current tends to flow along the surface of the belt causing poor transfer performance. A belt having volume resistivity higher than $10^{11}$ Ω-cm has a high resistance, so that current is difficult to flow through the belt causing poor transfer performance.

FIG. 19 is a table that lists the specifications of the secondary transfer roller 52*b* with the resin tube 83 fitted over it. The secondary transfer roller 52*b* has a smooth surface having a surface roughness Rz of 12 μm.

The operation of the image forming apparatus 10 according to the second embodiment will be described with reference to FIG. 16.

The photoconductive drum 51 is driven in rotation by a drive source, not shown, in a direction shown by arrow I. The charging roller 54 charges the surface of the photoconductive drum 51 uniformly. The LED exposing unit 75 illuminates the charged surface of the photoconductive drum 51 to form an electrostatic latent image of, for example, yellow in accordance with print data. The developing roller 56Y supplies yellow toner to the yellow electrostatic latent image to form a yellow toner image on the surface of the photoconductive drum 51.

The medium 26 advances in a direction shown by arrow J. The primary transfer roller 52*a* transfers the yellow toner image onto the intermediate transfer belt 71 when the yellow toner image arrives at the primary transfer point. Then, the neutralizing roller 61 neutralizes the surface of the photoconductive drum 51. The cleaning blade 62 removes the residual toner from the photoconductive drum 51. The above-described cycle of electrophotography is repeated for each color.

Thus, toner images of the respective colors are transferred onto the intermediate transfer belt 71 one over the other in registration, thereby forming a full color toner image.

Then, the secondary transfer roller 52*b* transfers the full color toner image from the intermediate transfer belt 71 onto the medium 26. It is to be noted that the full color toner image adheres to the medium 26 only by the Coulomb force. As the medium 26 passes through the fixing unit 31, the full color toner image is fused under pressure and heat into a permanent full color image. Then, the medium 26 is discharged onto a stacker 34.

FIG. 20 is a table that lists characteristics of the secondary transfer roller 52*b* according to the second embodiment.

Just as in the first embodiment, the inventor carried out an endurance test in which printing was performed on 50,000 pages of the medium 26 of a letter size, and compared the voltage dependency of the resistance of the secondary transfer roller 52*d*. Examples 1-6 were tested. FIG. 20 shows the pressing force $F_{TR}$ of the secondary transfer roller 52*b*, the voltage dependency of the resistance of the secondary transfer roller 52*b*, and the evaluation after the endurance test.

Referring to FIG. 20, when the endurance test was performed with a pressing force $F_{TR}$ of not smaller than 28 gf/cm and not larger than 112 gf/cm, ΔR was not smaller than 0.36 and not larger than 0.36 after the endurance test and the text pattern was good. When the endurance test was performed with a pressing force $F_{TR}$ of not smaller than 65 gf/cm and not larger than 112 gf/cm, ΔR was not smaller than 0.32 and not larger than 0.36 after the endurance test. The image quality before the endurance test was good enough.

The image quality was good for both halftone printing and text pattern printing after the endurance test.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A transfer unit that transfers an image formed on an image bearing body onto a medium by an electrostatic force, the transfer unit comprising:

at least one transfer roller including a resilient body formed of a polar rubber, and transferring a developer image onto a medium, wherein said transfer roller is pressed against the image bearing body under a pressing force in a range of 28-112 gf/cm.

2. The transfer unit according to claim 1, wherein the image bearing body is a photoconductive drum and a transfer belt is held between said transfer roller and the photoconductive drum in a sandwiched relation to define a transfer point between the transfer belt and the photoconductive drum, the transfer belt transporting the medium through the transfer point.

3. The transfer unit according to claim 2, wherein said transfer belt has a volume resistivity in the range of $10^{10}$-$10^{14}$ Ω-cm and a surface resistivity in the range of $10^{10}$-$10^{14}$Ω/□.

4. The transfer unit according to claim 1, wherein said image bearing body is an intermediate transfer belt;

wherein the resilient body includes an outer surface covered with a layer.

5. The transfer unit according to claim 4, wherein the layer has a volume resistivity $10^{7}$-$10^{11}$ Ω-cm.

6. The transfer unit according to claim 1, wherein said transfer roller is formed of a resilient foamed body having a hardness in the range of 25-45 degrees Askar C, wherein said transfer roller includes cells that expose on its surface, the cells having a diameter in the range of 200-500 μm.

7. The transfer unit according to claim 1, wherein the resilient body is formed of a material that contains a plurality of base polymer materials, one of the plurality of base polymer materials being an ethyleneoxide group.

8. The transfer unit according to claim 7, wherein the ethyleneoxide group has a high ionic conductivity.

9. The transfer unit according to claim 8, wherein at least one of the plurality of base polymer materials is an epichlorohydrin-ethylene oxide (ECO).

10. The transfer unit according to claim 7, wherein the plurality of base polymer materials include acrylonitrile-butadiene rubber (NBR) and an epichlorohydrin-ethylene oxide (ECO).

11. The transfer unit according to claim 1, wherein said transfer roller has a resistance in the range of $10^{5}$-$10^{10}$Ω.

12. The transfer unit according to claim 1, wherein said transfer roller includes a shaft on which the resilient body rotates;

wherein a difference between an outer diameter of the resilient body and an outer diameter of the shaft is not smaller than 2 mm.

13. The transfer unit according to claim 12, wherein the outer diameter of the shaft is not smaller than 6 mm.

14. The transfer unit according to claim 1, wherein the pressing force is in the range of 65-112 gf/cm.

15. An image forming apparatus incorporating said transfer unit according to claim 1.

16. The transfer unit according to claim 1, wherein the resilient body is a foamed body.

17. The transfer unit according to claim 16, wherein said transfer roller includes foamed cells that expose on its surface, the foamed cells having a diameter in the range of 200-500 μm.

18. The transfer unit according to claim 17, wherein the resilient body has a hardness in the range of 25-45 degrees Askar C.

19. The transfer unit according to claim 1, wherein the transfer roller includes a shaft covered with the resilient body, and the resilient body is a single layer of a foamed material.

* * * * *